US006147289A

United States Patent [19]

Kumano

[11] Patent Number: 6,147,289

[45] Date of Patent: Nov. 14, 2000

[54] KEYBOARD ASSEMBLY AND METHOD OF MANUFACTURING IT

[75] Inventor: Shinji Kumano, Hamamatsu, Japan

[73] Assignee: Yamaha Corporation, Hamamatsu, Japan

[21] Appl. No.: 09/281,014

[22] Filed: Mar. 30, 1999

[30] Foreign Application Priority Data

Sep. 25, 1998 [JP] Japan ..... 10-271926

[51] Int. Cl.[7] ..... G10C 3/12

[52] U.S. Cl. ..... 84/423 R; 84/433; 84/439; 84/440; 84/438

[58] Field of Search ..... 84/423 R, 433, 84/438, 439, 440

[56] References Cited

U.S. PATENT DOCUMENTS

| | | | |
|---|---|---|---|
| 4,602,549 | 7/1986 | Kumano | 84/433 |
| 5,062,342 | 11/1991 | Nagatsuma | 84/744 |
| 5,824,928 | 10/1998 | Kumano et al. | 84/423 R |
| 5,834,668 | 11/1998 | Kumano et al. | 84/423 R |

FOREIGN PATENT DOCUMENTS

| | | |
|---|---|---|
| 63-56554 | 11/1988 | Japan . |
| 2-256094 | 10/1990 | Japan . |
| 4-204796 | 7/1992 | Japan . |
| 2-508028 | 4/1996 | Japan . |

*Primary Examiner*—David Martin
*Assistant Examiner*—Shih-yung Hsieh
*Attorney, Agent, or Firm*—Pillsbury Madison & Sutro LLP

[57] ABSTRACT

A keyboard assembly for a keyboard instrument such as an electronic piano is constructed using a key, a first moving member, a second moving member and a key-depression switch. Herein, the key is supported by a keyboard frame to have a capability of rotating up and down about a rotation center. The first moving member is arranged beneath the key and is subjected to rotary motion about a first rotation center. The second moving member incorporating a deadweight has a larger weight and a longer moving distance as compared with the key and first moving member respectively. At the key depression, mode a back portion of the first moving member rotates upwardly so that the second moving member normally located at a rest position is subjected to rotary motion about a second rotation center. Thus, the second moving member rotates backwardly, and, it is stopped at a contact position defined by a back portion of the keyboard frame. Thereafter, the second moving member is subjected to back checking by which the second moving member is slightly moved forward and is temporarily fixed in position as long as the depression of the key is maintained. The key-depression switch is located beneath the key and is turned on to produce a musical tone in response to the depression of the key.

23 Claims, 11 Drawing Sheets

KEYBOARD ASSEMBLY AND METHOD OF MANUFACTURING IT

BACKGROUND OF THE INVENTION

1. Field of the Invention

This invention relates to keyboard assemblies used for acoustic musical instruments such as pianos as well as electronic musical instruments such as electronic pianos, for example. In addition, this invention also relates to methods of manufacturing the keyboard assemblies.

This application is based on Patent Application No. Hei 10-271926 filed in Japan, the content of which is incorporated herein by reference.

2. Description of the Related Art

In general, keyboard instruments such as the pianos and electronic pianos have characteristics that intensities of musical tones, which are generated using keyboards, reflect key-depression intensities. Therefore, engineers pay great attention to key-touch feelings of the keyboards such that performers are able to feel reactions of keys in response to intensities of the musical tones. Thus, it is demanded that the performer feels a heavy reaction in the motion of the key in response to "strong" key depression while the performer feels a "light" reaction in the motion of the key in response to "weak" key depression. In other words, the key provides the performer with resistance force when being depressed, wherein the resistance force varies in response to key-depression intensities applied to the key. However, it is difficult to provide variations of the resistance force of the key by elastic resistance using springs and the like. So, the variations of the resistance force of the key are actualized by inertial resistance of the key based on appropriately selected mass of the moving part(s) of the key.

In order to obtain good touch feelings of the keys of the keyboard, the moving parts of the keys should be designed to have certain degrees of mass. For this reason, a deadweight made of lead material is buried in each of the keys. Alternatively, moving parts of the key are constructed by two rotation members or more, which are interlocked with each other. Herein, each of the members is designed to have a certain degree of mass. Thus, it is possible to manufacture the keyboard which is somewhat compact in dimensions.

Conventionally, the acoustic musical instruments such as the pianos have the keyboards, which are normally designed to provide good touch feelings for the users to depress the keys. However, those keyboards are complicated in constructions and are disadvantageous because of relatively heavy weights thereof. On the other hand, the electronic musical instruments frequently use the keyboards having simple constructions. For example, the paper of U.S. Pat. No. 4,602,549 (corresponding to Japanese Patent Publication No. Sho 63-56554) discloses an example of the keyboard in which the moving parts of the keys are designed to have certain weights. However, this keyboard is not designed to provide the keys with inertial resistances in an efficient way. In addition, the paper of Japanese Patent No. 2,508,028 discloses another type of the keyboard, which is designed such that the key is interlocked with a mass body such as a hammer to increase inertial resistance. Because of relatively heavy weight of the mass body, the keyboard as a whole is likely heavy in total weight. So, it is impossible to provide improvements in touch feelings efficiently with respect to weights of the keys. As described above, it is a reality that in spite of the weights applied to the keys, the conventional keyboards are unable to provide the keys with good touch feelings. In addition, the weights are applied to all keys which range from several tens of keys to eighty-eight keys. Therefore, the conventional keyboards is likely heavy in total weights.

SUMMARY OF THE INVENTION

It is an object of the invention to provide a keyboard assembly having a simple construction, which is capable of providing keys with good touch feelings in response to key-depression intensities by efficient creation of inertial resistances required for the keys.

It is another object of the invention to provide a keyboard assembly whose total weight is relatively small.

It is a further object of the invention to provide a method for manufacturing the keyboard assemblies.

A keyboard assembly of this invention is provided for a keyboard instrument such as an electronic piano and is constructed using a key, a first moving member, a second moving member and a key-depression switch. Herein, the key is supported by a keyboard frame to have a capability of rotating up and down about a rotation center. The first moving member is arranged beneath the key and is subjected to rotary motion about a first rotation center. The second moving member is greater in mass and moving distance as compared with the key and first moving member. At the key depression, mode a back portion of the first moving member rotates upwardly so that the second moving member normally located at a rest position is subjected to rotary motion about a second rotation center. Thus, the second moving member rotates backwardly, and, is stopped at a contact position defined by a back portion of the keyboard frame. Thereafter, the second moving member is subjected to back checking by which the second moving member is slightly moved forward and is temporarily fixed in position as long as the depression of the key is maintained. The key-depression switch is located beneath the key and is turned on to produce a musical tone in response to the depression of the key.

For example, a deadweight is attached to a tip end portion of the second moving member to determine its center of mass such that the center of mass is located forwardly from the second rotation center even when the second moving member rotates backwardly to reach the contact position. In addition, a center of mass of the key is located forwardly from the rotation center thereof while a center of mass of the first moving member is located backwardly from the first rotation center.

Incidentally, a mass m of the deadweight is determined in accordance with a relational expression of $$k^2 m \approx (FT^2)/(2D)$$

where k denotes a (mechanical) magnification ratio, F denotes key-depression force, D denotes a maximal moving distance of the key at its key-depression position, and T denotes a time required for the key to achieve the maximal moving distance D.

BRIEF DESCRIPTION OF THE DRAWINGS

These and other objects, aspects and embodiment of the present invention will be described in more detail with reference to the following drawing figures, of which.

DESCRIPTION OF THE PREFERRED EMBODIMENT

This invention will be described in further detail by way of examples with reference to the accompanying drawings.

[A] Design Concept for Keyboard Assembly

The key-touch feelings at key-depressions (hereinafter, simply referred to as "key-depression-touch feelings") can be recognized as feelings of resistance to key depressions, in other words, resistance force which is applied to the finger by the depressed key and its interlocking member(s). Now, a description will be given with respect to a relationship between key-depression force (or resistance force at key-depression, which will be referred to as "key-depression resistance force") and motion of an interlock mechanism for each of the keys.

Figure 11:
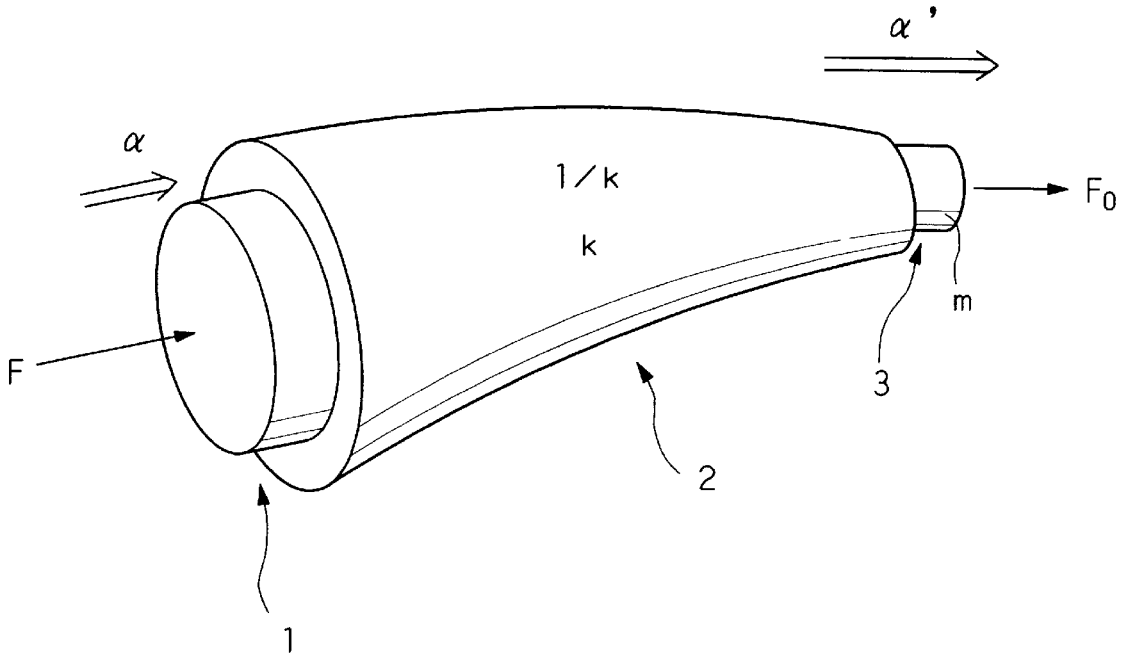
FIG. 11 is a diagrammatic figure showing an example of a general motion system that corresponds to a key and its interlocked parts.

Suppose a general kinematic system, which is shown in FIG. 11 and is configured by three elements such as an input unit, a transmission mechanism and an output unit. Herein, the input unit represents a key, while the transmission mechanism transmits an input given from the input unit with the transmission being increased or decreased. An output of the transmission mechanism is made through the output unit.

Operations of the aforementioned elements are described as follows:

(1) Input unit 1: Force "F" is applied to a member (i.e., key) so that an input member of the input unit moves at acceleration $\alpha$.

(2) Transmission mechanism 2: The input force F is multiplied by "1/k" and is then transmitted to the output unit, whereby speed of the input unit is increased by a multiplication factor "k". For convenience' sake, the present description is given such that masses of the input unit and transmission mechanism are negligible.

(3) Output unit 3: Due to transmission of the force from the transmission mechanism, a moving part of the output unit having mass "m" moves at acceleration $\alpha'$.

If the output unit 3 outputs force Fo in response to the input force F, a relationship between F and Fo is given based on characteristics of the transmission mechanism, by an equation (1) as follows:

$$Fo=(1/k)F \tag{1}$$

If the aforementioned members of the input unit and output unit move at speeds v and v' respectively after elapse of time "t", there is established a relationship as follows:

$$v'=kv$$

Because of relationships of $v=\alpha t$ and $v'=\alpha' t$, the above equation is changed as follows:

$$\alpha'=k\alpha \tag{2}$$

Therefore, a relationship between force and acceleration at the output unit is given by an equation as follows:

$$Fo=m\alpha'$$

So, by using the aforementioned equations (1) and (2), the above equation is changed as follows:

$$(1/k)F=mk\alpha$$

The above equation is further transformed as follows:

$$F/\alpha=k^2m \tag{3}$$

Now, suppose a situation that the input unit corresponds to a key of the keyboard while key-depression force is constant so that a time required for full-stroke key depression is constant. In that situation, elements F and $\alpha$ of the equation (3) are constant. Thus, left side of the equation (3) is constant. For this reason, it can be said with respect to right side of the equation (3) that an element $k^2$ is inversely proportional to an element m.

Therefore, it can be said that if a coefficient k of the transmission mechanism is increased, in other words, if a magnification ratio of the speed is increased, a mass of the output unit should be decreased to be inversely proportional to the square of the coefficient k. In addition, the speed of the output unit is proportional to a moving distance of the output unit. So, if the aforementioned kinematic system employs the transmission mechanism which makes the moving distance of the output unit large, it is possible to produce input resistance of the input unit efficiently with the small mass of the output unit.

Figure 12A:
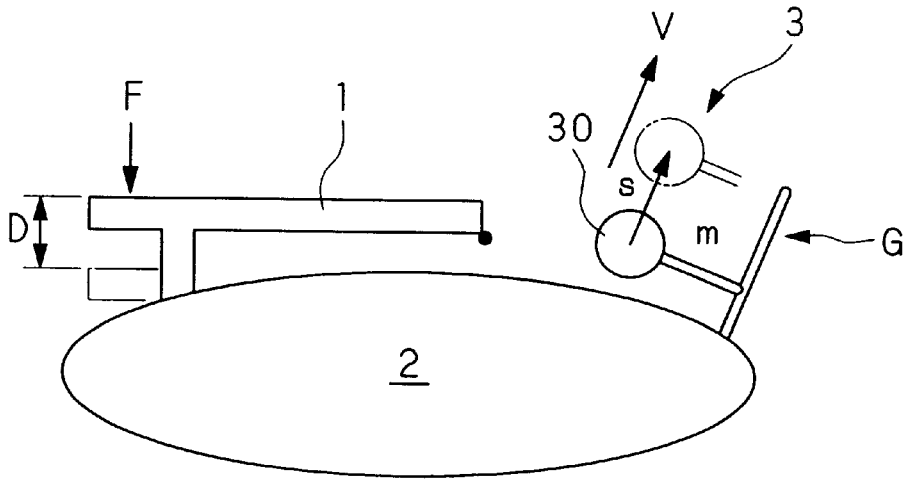
FIG. 12A is a diagrammatic figure showing a model A used for explaining a motional relationship between a key and a moving part which is subjected to rectilinear motion.
Figure 12B:
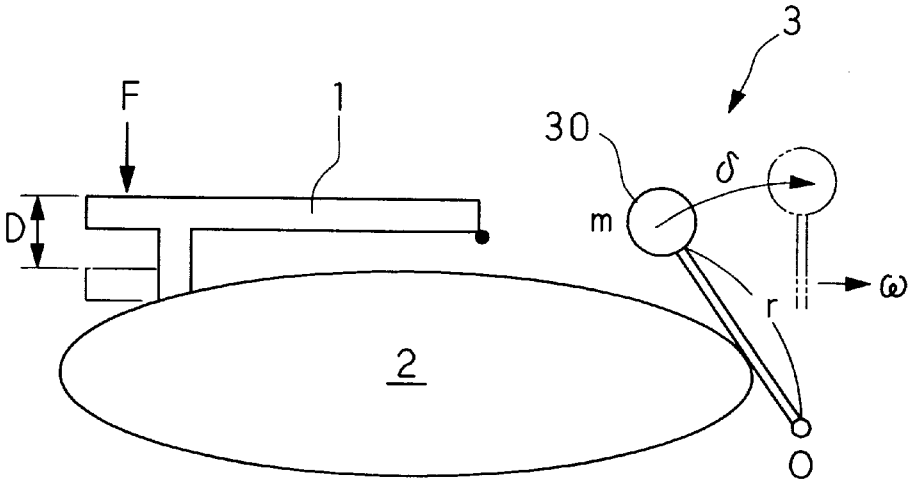
FIG. 12B is a diagrammatic figure showing a model B used for explaining a motional relationship between a key and a moving part which is subjected to rotary motion.

Next, a further description will be given with respect to the aforementioned operations in another aspect, which is concerned with motions of the key and moving part. Herein, the description is given using two kinds of models, i.e., model A and model B, as shown in FIG. 12A and FIG. 12B, respectively, each of which is constructed by a key 1, a transmission mechanism 2 and a moving part 3. In each of the above models, the key 1 is depressed with force F so that the key 1 moves downward to stop with distance D. Such downward motion of the key 1 is transmitted to the moving part 3 by means of the transmission mechanism 2 which has a lever or the like.

Then, the moving part 3 makes different behaviors with respect to the models A and B, as follows:

(1) Model A: The moving part 3 is subjected to rectilinear motion along a guide G and is given a deadweight 30 of mass "m".

(2) Model B: The moving part 3 is subjected to rotary motion about an origin point "O", so that the moving part 3 is given a deadweight 30 of mass m at a position which is apart from the point O by a rotation radius "r" of the moment of inertia.

For convenience' sake, the key depression is made under the conditions that the key-depression force F is constant while masses of the key 1 and transmission mechanism 2 as well as mass of an arm of the moving part are all negligible.

Work made by the finger to depress the key, in other words, key-depression energy $E_1$, is given by an equation as follows:

$$E_1=FD \tag{A0}$$

The moving part is moved by the transmission mechanism 2, so that in the aforementioned model, the deadweight 30 increases in velocity thereof from initial velocity "0" to final velocity. Thus, the moving part comes in contact with a sound body and/or a support plate. Therefore, the energy which is applied to the moving part by the transmission mechanism is equivalent to the kinetic energy of the deadweight 30 represented by the speed just before the deadweight 30 leaves from the transmission mechanism. Specifically speaking, there is an increase of potential energy of the deadweight 30 in the case where motion of the deadweight 30 is accompanied with upward motion. However, as compared with speed energy of the deadweight 30, an amount of the potential energy due to the upward motion is very small and is negligible. In the meantime, energy that the transmission mechanism applies to the moving part is equivalent to energy that the finger applies to the key. Therefore, the key-depression energy can be transformed to kinetic energy of the moving part.

Next, a description will be given with respect to calculations to produce kinetic energies with respect to the models A and B respectively.

(1) Model A

Energy $E_2$ of the moving part in rectilinear motion system is given by an equation as follows:

$$E_2=(1/2)mv^2 \tag{A1}$$

Now, suppose a situation that the deadweight 30 is subjected to uniformly accelerated motion, in which the deadweight 30 is accelerated from initial velocity "0" by acceleration $\alpha$. After elapse of time "t", moving distance "s" of the moving part is given by an equation as follows:

$$s=(1/2)\alpha t^2 \tag{A2}$$

Now, the deadweight 30 has velocity "v" where $\alpha=v/t$, which is used to transform the equation A2 as follows:

$$s=(1/2)vt$$

The above equation is further transformed as follows:

$$v=2s/t$$

By using the above equation, the equation A1 is transformed to an equation as follows:

$$E_2=(1/2)m\cdot(2s/t)^2=2ms^2/t^2 \tag{A3}$$

Because of $E_1=E_2$, the aforementioned equations (A0) and (A3) are combined together to form an equation as follows:

$$FD=2ms^2/t^2$$

Herein, "t" designates the time required for key depression, in other words, the time that the deadweight 30 moves. Therefore, the time t can be replaced with a constant time "T", so that the above equation is transformed as follows:

$$FD=2ms^2/T^2$$

According to the above equation, when the moving distance "s" of the deadweight 30 is made longer under the condition that the key-depression energy is constant, the mass "m" of the deadweight 30 can be made small to be inversely proportional to the square of the moving distance "s".

(2) Model B

Energy $E_3$ of the moving part in rotary motion system is given by an equation as follows:

$$E_3=(1/2)I\omega^2 \tag{B1}$$

where "ω" represents angular velocity of the moving part while "I" represents moment of inertia.

Because the deadweight 30 having mass m is subjected to rotary motion having a radius r, the moment of inertia "I" is given as follows:

$$I=r^2m$$

Therefore, the equation (B1) is transformed to an equation as follows:

$$E_3=(1/2)r^2m\omega^2 \tag{B2}$$

According to a presumption that the deadweight 30 is subjected to uniformly accelerated circular motion in which it is accelerated from initial velocity "0" by acceleration $\mu$, moving distance δ of the deadweight 30 after elapse of the time t is given by an equation as follows:

$$\delta=(1/2)r\mu t^2 \tag{B3}$$

Herein, a relationship of $\mu=\omega/t$ is introduced to the equation (B3), as follows:

$$\delta=(1/2)r\omega t$$

The above equation is further transformed to an equation as follows:

$$\omega=(2\delta)/(rt)$$

The above equation is introduced to the aforementioned equation (B2) to create an equation as follows:

$$E_3=(1/2)r^2m\cdot\{(2\delta)/(rt)\}^2=2m\delta^2/t^2 \tag{B4}$$

Because of a relationship of $E_1=E_3$, the aforementioned equation A0 is combined with the equation (B4) to form an equation as follows:

$$FD=2m\delta^2/T^2$$

According to the above equation, it can be said that if the moving distance δ of the deadweight 30 is made longer under the condition where the key-depression energy is constant, the mass m of the deadweight 30 can be made small to be inversely proportional to the square of the moving distance δ.

As described heretofore, it is concluded that in both of the rotary motion system and rectilinear motion system, if the moving distance of the deadweight of the moving part is made longer under the condition that the key-depression energy is constant, the weight of the deadweight can be made small to be inversely proportional to the square of the moving distance.

According to one aspect of this invention, there is provided a keyboard assembly in which a key is interlocked with an intermediate moving member (e.g., first moving member) and a large-mass moving member (e.g., second moving member) at a key-depression mode. Herein, as compared with the key and intermediate moving member, the large-mass moving member is increased in moving distance and weight. That is, the large-mass moving member has longer moving distance as well as heavier weight. Thus, it is possible to efficiently produce large inertia force (i.e., key-depression resistance force). In other words, by applying a relatively small mass to the key, it is possible to produce relatively large inertia resistance. Such a characteristic is applied to all of the keys of the keyboard assembly. So, as compared with the conventional keyboard assembly, it is possible to reduce total weight of the keyboard assembly.

If the key, intermediate moving member and large-mass moving member are respectively subjected to rotary motions about axes, a moving distance of a radius portion in rotation of the moment of inertia is made longer than moving distances of radius portions of rotation axes of the key and intermediate moving member respectively. Incidentally, the radius r of the rotation can be calculated using the moment of inertia I and mass m in accordance with an equation as follows:

$$r=(I/m)^{1/2}$$

Herein, it is possible to approximately recognize the radius of the rotation as the distance between the axis and the center of mass of the large-mass moving member. In the large-mass moving parts, elements made of metal material of high specific gravity are generally concentrated at the certain portions. For this reason, as the elements having large masses are arranged in a concentrated manner, the radius of rotation of the moving part becomes close to the distance between the rotation axis and center of mass.

If the large-mass moving part is subjected to rectilinear motion guided by a guide portion (or guide portions), a moving distance of the center of mass of the large-mass moving part is made longer than distances of centers of mass of the key and intermediate moving member respectively.

According to another aspect of this invention which corresponds to a method for manufacturing the keyboard assembly, constant values are respectively set to the key-depression force F and maximal moving distance D measured at the key-depression position as well as the time T required for key depression actualizing the maximal moving distance D. Herein, the mass m of the mass body and magnification ratio k for increasing an operation speed of the key by the mechanical magnification system are determined by a relational expression as follows:

$$k^2m=(FT^2)/(2D) \quad (4)$$

This expression is created as follows:

A relationship between the acceleration a and maximal moving distance D of the key is given by "$D=(\frac{1}{2})\alpha t^2$", which is transformed to "$\alpha=2D/t^2$", so the aforementioned relational expression is given by introducing this equation to the aforementioned equation (3), i.e., "$F/\alpha=k^2m$".

Namely, the aforementioned relational expression is an equivalence of the equation (3), wherein $\alpha$ is represented by D and T. For this reason, if the constant values are respectively set to the key-depression force F, maximal moving distance D and time T while they are input to the relational expression (4), it is possible to calculate k and m that establish the equation (3) with ease. In consideration of the actual keyboard assembly, however, there is a limit in concentration of mass even if a large part of mass of the key is concentrated at the large-mass moving member while the mass of the large-mass moving member is concentrated at a prescribed portion. Therefore, the aforementioned equation (4) may be interpreted that the left side (i.e., "$k^2m$") is nearly equal to the right side (i.e., "$(FT^2)/(2D)$"). Anyway, using the aforementioned equation(s), it is possible to manufacture the keyboard assembly, which is capable of efficiently producing the large inertia force (or key-depression resistance force), with ease.

According to a further aspect of the invention, at a key-depression mode, a center of mass of the large-mass moving member rotates upwardly about its center of rotation from a rest position, which is arranged approximately horizontal to the center of rotation, to a rotation position which is approximately arranged vertical to the center of rotation. At the rest position, the large-mass moving member is arranged approximately horizontal to the center of rotation. So, at an initial stage of the key depression, inertia resistance occurs due to masses of the key and its interlocked members while gravity of the large-mass moving member also works as inertia resistance. Those inertia resistances contribute to resistance feeling of the key which is depressed. As the key-depression operation progresses, the large-mass moving member reaches the rotation position which is arranged approximately vertical to the center of rotation. For this reason, the resistance force due to the weight of the large-mass moving member decreases. That is, the key-touch feeling of the depressed key is subjected to controlled variations such that at the initial stage of the key-depression operation, the performer feels somewhat heavy touch, which is decreased as the key-depression operation progresses deeply. By the way, at a weak key-depression mode that the performer depresses the key with weak key-depression force, there is an increased ratio in occupation of the resistance due to the weight of the large-mass moving member within the total inertia resistance. For this reason, this invention is capable of demonstrating the effects thereof particularly at the weak key-depression mode. In other words, the aforementioned controlled variations of the key-touch feelings offer an important function in reflection of the delicate touch of the key in weak sound performance. In short, the key-touch feelings of this invention are very close to those of the acoustic musical instruments such as the pianos. Further, the center of mass of the large- mass moving member at the rotation position is provided closer to the side of the rest position than the vertical line passing through the center of rotation of the large-mass moving member. For this reason, when the performer releases the key depression, the large-mass moving member automatically returns from the rotation position to the rest position due to the own weight thereof. That is, it is possible to perform return operation of the large-mass moving member without using the return spring or else. Thus, it is possible to simplify construction of the key and its interlocked members. However, it is possible to additionally use the return spring by which the large-mass moving member can speedily perform the return operation.

Now, this invention will be described in further detail by way of examples with reference to the accompanying drawings. Incidentally, the drawings are described in such a way that the side of the performer who plays the keyboard is referred to as a "front side" while its reverse side (e.g., in case of the upright piano, the side where strings are arranged) is referred to as a "back side".

[B] Embodiment 1

Figure 1:
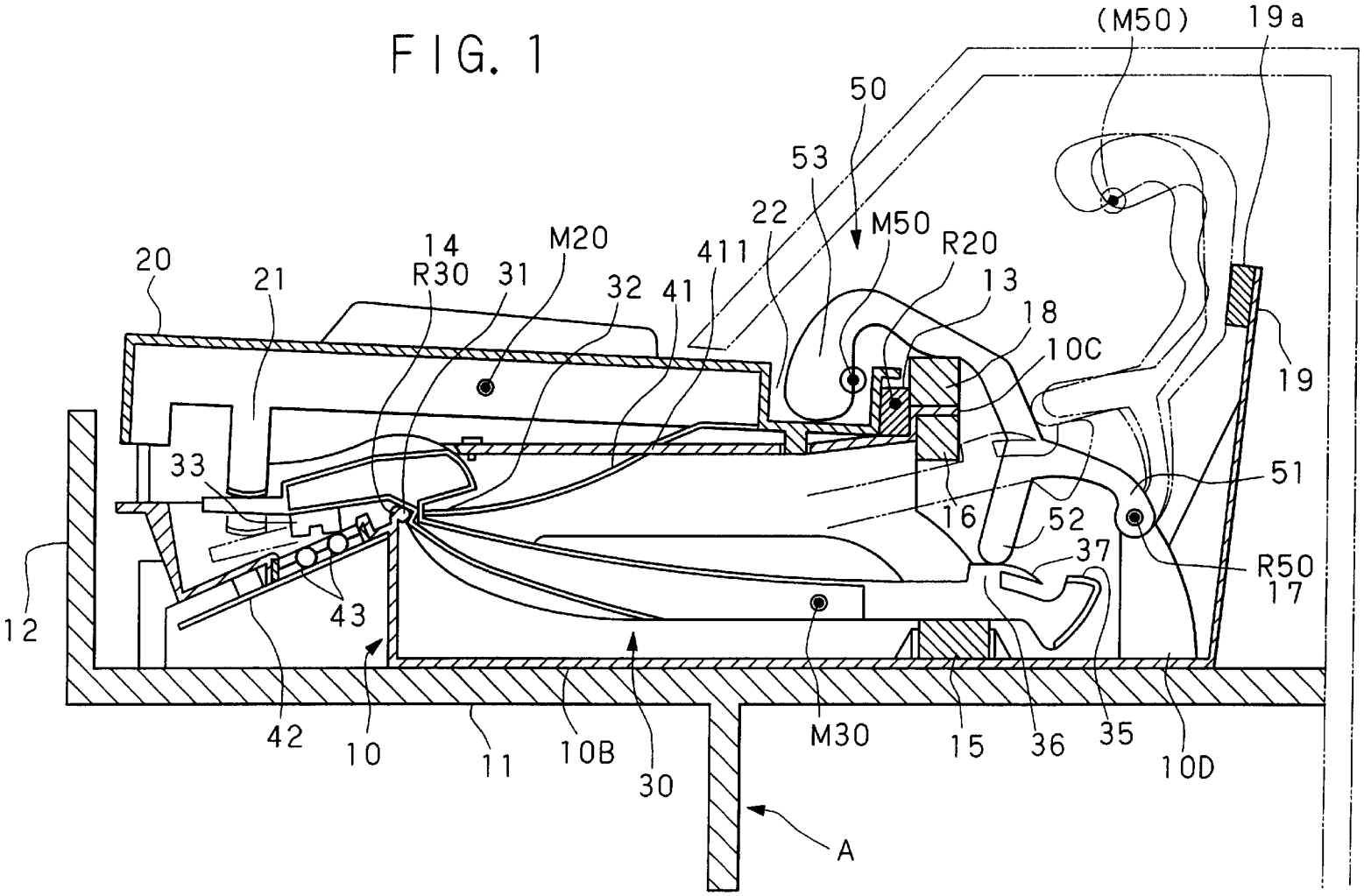
FIG. 1 is a longitudinal sectional view showing a construction of a keyboard assembly in accordance with embodiment 1 of the invention.

FIG. 1 is a longitudinal sectional view showing a construction of a keyboard assembly used for an electronic piano in accordance with embodiment 1 of the invention. In the keyboard assembly of FIG. 1, all keys of a keyboard are supported by a keyboard frame 10, which has a shelf board (or keybed) 11 and a base rod 12. Herein, the keyboard frame 10 is supported by a case A covering the keyboard assembly as a whole. The keyboard contains keys 20, which consist of white keys and black keys. A support member 13 is located slightly backward from the center of the keyboard frame 10, wherein it elongates in a width direction. Each key 20 is supported by the support member 13 in such a way that it is capable of rotating up and down about a rotation center R20, which is located in proximity to a contact point between the support member 13 and a back end of the key 20. Beneath the key 20, a first moving member 30 corresponding to an intermediate moving member is supported by the keyboard frame 10. The first moving member elongates horizontally as a whole in front-back directions. A support element 14 stands at a position near a front side of the keyboard frame 10, wherein it is engaged with a concave 31. Thus, the first moving member 30 rotates about an rotation center R30, which corresponds to a tip end portion of the support element 14. To retain an engaged state established between the tip end portion of the support element 14 and the concave 31, a first end of a S-shaped spring 41 presses a concave 32. The concave 32 is located just backwardly from the concave 31 of the first moving member 30 and is formed by a rib having a certain width in a horizontal direction. A thin plate extends vertically at a center of a width direction of the rib. The first end of the S-shaped spring 41, which engages with the concave 32, is formed forkedly to have a slit at a center thereof. So, the thin plate is inserted into the slit to establish engagement between the concave 32 and the first end of the S-shaped spring 41. A middle portion of the spring 41 presses and comes in contact with a center hole 411, which is formed approximately at a center position of an upper portion of the keyboard frame 10. A second end of the spring 41 presses a spring bearing corresponding to a lower back portion of the key 20. Thus, the S-shaped spring 41 presses the first moving member 30 to the tip end portion of the support element 14 at the position of the concave 32.

A front end portion of the first moving member 30 is brought into contact with a lower end of a hang-down element 21 of the key 20. In response to depression of the key 20, the first moving member 30 rotates with being interlocked with the key 20. Incidentally, descending positions of the key 20 and the first moving member 30 are shown by dashed lines drawn at a left area of FIG. 1.

Beneath the front end portion of the first moving member 30, a switch board 42 is supported by the keyboard frame 10. A pair of conductive members 43 are fixed to a surface of the switch board 42. Herein, the conductive members 43 are made of conductive rubber material and are formed to have a cross section shaped like a pair of glasses. An actuator 33 is attached to a lower surface of a front portion of the first moving member 30 at a position which meets the conductive members 43. Herein, the actuator 33 is equipped with a pair of legs which elongate downwardly. A set of the aforementioned actuator 33, switch board 42 and conductive members 43 construct a key-depression switch, which senses key-depression velocity based on a difference between conduction start times corresponding to different contact distances at a key-depression mode.

The first moving member 30 elongates backwardly to reach a back portion of the keyboard frame 10. At a rest position which corresponds to a non-key-depression state, a back end portion of the first moving member 30 is supported by a felt stopper member 15, which is fixed a bottom wall 10B of the keyboard frame 10 on the shelf board 11. The back end portion of the first moving member 30 is rounded with an elastic body to form a back-check portion 35, which performs back checking on rotation of a second moving member (which will be described later). In addition, a press-up portion 36 is formed to project upwardly from the first moving member 30 in proximity to and in front of the back-check portion 35. A back portion of the press-up portion 36 is formed like a claw 37 which is an elastic body and extends backwardly. Herein, the claw 37 is formed like an arc to be thinner in thickness in a tip-edge direction thereof. A tip edge portion of the claw 37 extends backwardly to be in proximity to the back-check portion 35. As the key 20 is depressed, the first moving member 30 moves from the rest position shown by solid lines to a key-depression position shown by dashed lines in FIG. 1. At a back area of the keyboard frame 10 which is located just after the back end portion of the key 20, a hold member 10C holds a felt stopper member 16. This felt stopper member 16 plays a role to stop a motion of the first moving member 30 interlocked with the key 20 which reaches the key-depression position.

The back portion of the keyboard frame 10 is equipped with a second moving member 50 which corresponds to a large-mass moving member. The second moving member 50 is capable of rotating about a rotation center R50 corresponding to a shaft 17. At the rest position, a base end portion 51 is attached to the shaft, which is supported by a support portion 10D of the keyboard frame 10. Due to the rotation of the second moving member 50, a center of mass "M50" moves up and down in response to a key-depression operation of the key 20. At the rest position, the second moving member 50 as a whole looks like a reverse "W" shape. A lower end of a center projection 52 of the second moving member 50 comes in contact with an upper surface of the press-up portion 36 of the first moving member 30. A tip end portion of the second moving member 50, which is formed opposite to the rotation center R50 at the rest position where the second moving member 50 looks like the reverse "W" shape, is bent large toward the back end portion of the key 20. A recess 22 is formed at the back end portion of the key 20 to locate the tip end portion of the second moving member 50. This recess 22 is provided to increase a moving distance of the second moving member 50 at the key-depression mode. A felt stopper member 18 is located just backwardly from the back end portion of the key 20 and is held by a hold portion 10C of the keyboard frame 10. At the rest position, the second moving member 50 falls forward and is held at a position regulated by the felt stopper member 18. At the key-depression mode, the second moving member 50 moves from the position shown by solid lines to the position shown by dashed lines. Around the back end portion of the keyboard frame 10, a contact element 19*a* of a felt stopper member is supported by a support plate 19 which stands approximately vertical from the bottom wall 10B. Such a contact element 19*a* of the felt stopper member plays a role to stop a motion of the second moving member 50 which moves in response to the depression of the key 20.

Next, a description will be given with respect to centers of mass of the key 20, first moving member 30 and second moving member 50. The present embodiment performs approximation using the distance between the rotation axis and the center of mass of the member instead of the foregoing rotation radius portion. All of the white keys and black keys constructing the keys 20 are made of plastics. As shown in FIG. 1, a center of mass "M20" of the key 20 is approximately located at a center in front-back directions of the key 20. The first moving member 30 is made of plastics. As compared with a front portion, the back portion of the first moving member 30 is made thick to provide a certain degree of durability and strength. The front portion or else other than the back portion of the first moving member 30 is made thin and is reinforced using ribs. As a result, the center of mass "M30" is located slightly backward from a center in an overall length of the first moving member 30. The second moving member 50 as a whole is made of plastics. In addition, a lead element (or lead elements) or else is buried in and is securely fixed into the tip end portion 53 of the second moving member 50. Therefore, the second moving member 50 has a relatively large mass, wherein a center of mass "M50" is located to be biased toward the tip end portion 53. In other words, the tip end portion 53 of the second moving member 50, which travels relatively large distance, is formed to have a relatively large mass, by which the second moving member 50 is capable of automatically returning to the rest position from a rotation position by own weight thereof. At the rotation position of the second moving member 50, a position of the center of mass M50 should be located backward from the rotation center R50. The present embodiment shown in FIG. 1 provides the recess 22 at the back end portion of the key 20. However, it is possible to omit the recess 22 by some modification as follows:

The first moving member 30 is further elongated in a backward direction, so that a fixed position of the second moving member 50 is shifted backwardly. Or, the support plate 19 of the keyboard frame 10 is shifted in a forward direction, so that at the rotation position of the second moving member 50, the center of mass M50 is located forward from the rotation center R50 even if the tip end portion 53 is not bent large.

Next, a description will be given with respect to operations of the keyboard assembly shown in FIG. 1. FIG. 1 basically shows a rest state of the keyboard before key depression. When a human operator (or performer) depresses the key 20 at the rest position, the front portion of the key 20 rotates downwardly about the rotation center R20, so that the hang- down element 21 depresses down the front end portion of the first moving member 30. Thus, the first moving member 30 rotates about the rotation center R30, while the actuator 33 descends down toward a pair of the conductive members 43. Being accompanied with descending of the key 20, the first moving member 30 and the second moving member 50 are subjected to operations, which will be described below.

The back portion of the first moving member 30 rotates upwardly about the rotation center R30, so that the press-up portion 36 presses up the center projection 52 of the second moving member 50. Thus, the second moving member rotates backwardly about the rotation center R50. Being accompanied with rotation of the second moving member 50, a contact point between the press-up portion 36 of the first moving member 30 and the center projection 52 of the second moving member 50 is moved backwardly, then, it finally reaches a tip end of the claw 37. Thereafter, the center projection 52 leaves from the claw 37 because of inertia of the second moving member 50. Then, the second moving member 50 is brought into contact with the contact element 19*a*. However, actual motion of the second moving member 50 depends on a key-depression manner. That is, in some key-depression manner, the second moving member 50 does not leave from the claw 37 and is not brought into contact with the contact element 19*a*. At a contact state that the second moving member 50 is certainly placed in contact with the contact element 19*a*, or at a nearly contact state that the second moving member 50 is located slightly forward from the contact element 19*a*, the actuator 33 of the key 20 comes in contact with a pair of the conductive members 43, so that the aforementioned key-depression switch is turned on. This activates a sound mechanism of the electronic piano to produce a musical tone.

When the second moving member 50 is brought into contact with the contact element 19*a*, it rebounds to move forward due to the contact with the contact element 19*a*. So, the center projection 52 comes in contact with the back-check portion 35 of the first moving member 30. Thus, the second moving member 50 is held at a position which is slightly apart from the contact element 19*a*. In short, the second moving member 50 after the rebound is subjected to back checking by the back-check portion 35. In other words, just after the second moving member 50 comes in contact with the contact element 19*a* which corresponds to the sound body of the acoustic musical instrument such as the string and metal element, the back-check portion 35 stops a return motion of the second moving member 50. At a contact position of the second moving member 50 at which the second moving member 50 is brought into contact with the contact element 19*a*, the center of mass M50 is located slightly forward from the rotation center R50. In addition, the center of mass M20 of the key 20 is located forward from the rotation center R20, while the center of mass M30 of the first moving member 30 is located forward from the rotation center R30. Therefore, when the human operator releases the key depression, all of the key 20, first moving member 30 and second moving member 50 are returned to the rest positions respectively because the centers of mass thereof descend down due to the gravity.

According to the keyboard assembly of the present embodiment, the second moving member 50 interlocked with the key 20 at the key-depression mode has a longer moving distance and a larger mass as compared with the key 20 and the first moving member 30. For this reason, it is possible to produce large inertia force (or key-depression resistance force). In other words, it is possible to produce relatively large inertia resistance by merely providing relatively small mass.

In order to secure the back checking of the second moving member 50, the present embodiment employs a well-considered structure, which will be described below.

Figure 2:
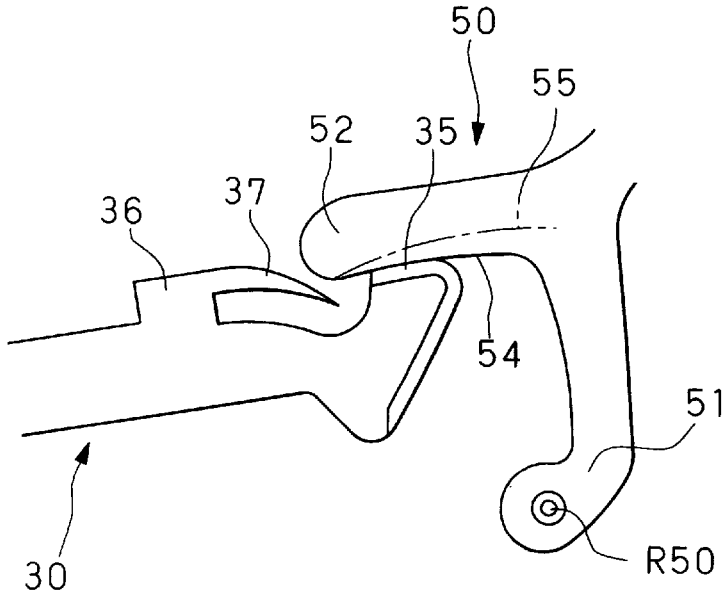
FIG. 2 is an enlarged view showing a positional relationship between first and second moving members in a back-check state.

FIG. 2 shows a positional relationship between the first moving member 30 and the second moving member 50 in a back-check state. A lower surface of the center projection 52 of the second moving member 50 is formed as a concave surface 54 having an arc shape. The concave surface 54 is determined in such a way that a distance measured from the rotation center R50 becomes slightly small as it changes from the tip end side to the base end side of the center projection 52. In FIG. 2, a circular arc 55 shown by a dashed line corresponds to a uniform distance which is measured from the rotation center R50. A conic portion is observed between the concave surface 54 and the circular arc 55 in the center projection 52, wherein dimensions thereof are gradually increased in a rightward direction in FIG. 2. Such a conic portion works as a kind of a cuneiform whose tip end is directed in a return rotation direction. The back-check portion 35 of the first moving member 30 is retained at an ascending position due to the key depression, while the second moving member 50 rebounds by the contact element 19*a* so that the center projection 52 is brought into contact with the back-check portion 35 in an elastic manner. At this time, due to a cuneiform effect, certain pressure whose intensity gradually increases in a contact process is produced between the concave surface 54 of the center projection 52 and the back-check portion 35. This avoids an event that a detent action of the second moving member 50 becomes insufficient as well as an event that after the contact with the back-check portion 35, the second moving member 50 is subjected to recurrence of backward movement or rebound. In other words, the conic portion and the back-check portion 35 provides a cuneiform cushioning effect for the impact created when the center projection 52 of the second moving member 50 makes a contact with the first moving member 30.

Figure 4:
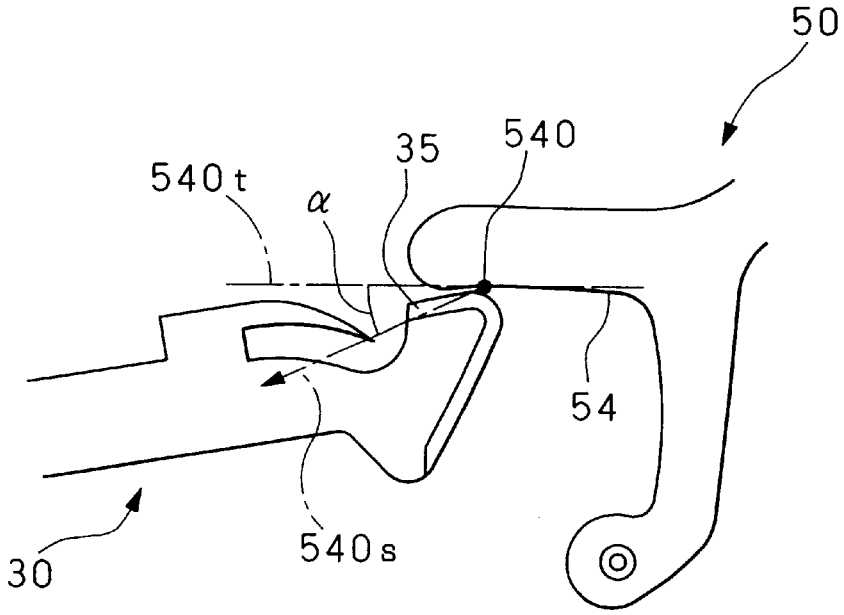
FIG. 4 is an enlarged view for explaining a positional relationship between the first and second moving members to offer a cuneiform effect at the back checking.

In FIG. 4, a reference symbol "540" designates a point at which the lower surface 54 of the center projection 52 comes in contact with the upper surface of the back-check portion 35. This point 540 moves in a direction shown by an arrow of dashed line "540*s*", which corresponds to a tangential direction in rotation about the rotation center R50. In addition, a reference symbol "540*t*" designates a tangential plane which is formed with respect to the lower surface 54 of the center projection 52 at the point 540. Herein, an angle $\alpha$ is formed between the tangential direction 540*s* and the tangential plane 540*t*. In order to obtain the cuneiform effect appropriately at a back-check mode, such an angle $\alpha$ should be small. Preferably, the angle $\alpha$ should be 45 degrees or less.

Figure 5:
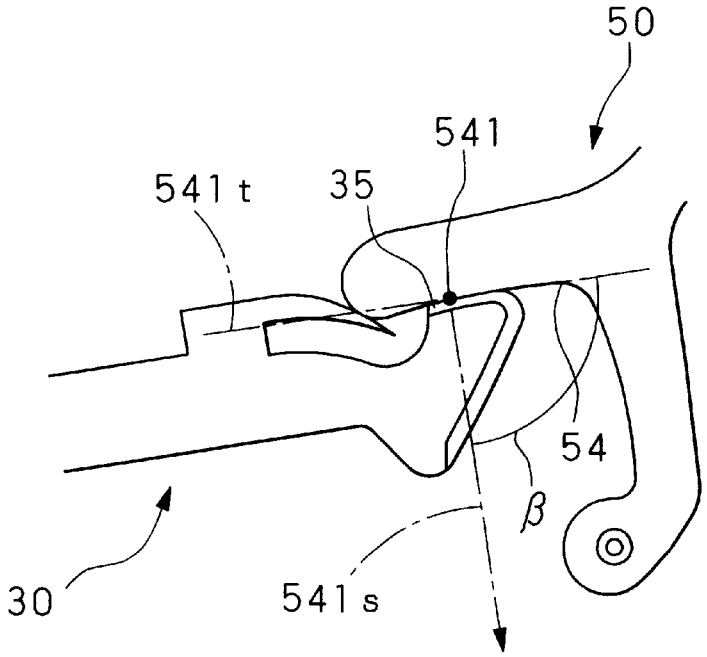
FIG. 5 is an enlarged view for explaining a positional relationship between the first and second moving members to avoid influence of the cuneiform effect.

In order to separate the back-check portion 35 from the center projection 52 after the back checking, it is preferable that the first and second moving members perform operations which are not influenced by the foregoing cuneiform effect. When the human operator releases the key depression, the first moving member 30 is subjected to return rotation, so that the back-check portion 35 descends down. That is, as shown in FIG. 5, the back-check portion 35 is brought into contact with the lower surface 54 of the center projection 52 at a point 541, from which the back-check portion 35 moves in a moving direction 541*s*. It is preferable that such a moving direction 541*s* of the back-check portion 35 should be close to a vertically descending direction. Preferably, the moving direction 541*s* of the back-check portion 35 is inclined to a tangential plane 541*t*, which is tangential to the lower surface 54 of the center projection 52 at the point 541, with an angle of inclination which is normally 45 degrees or more.

Figure 3:
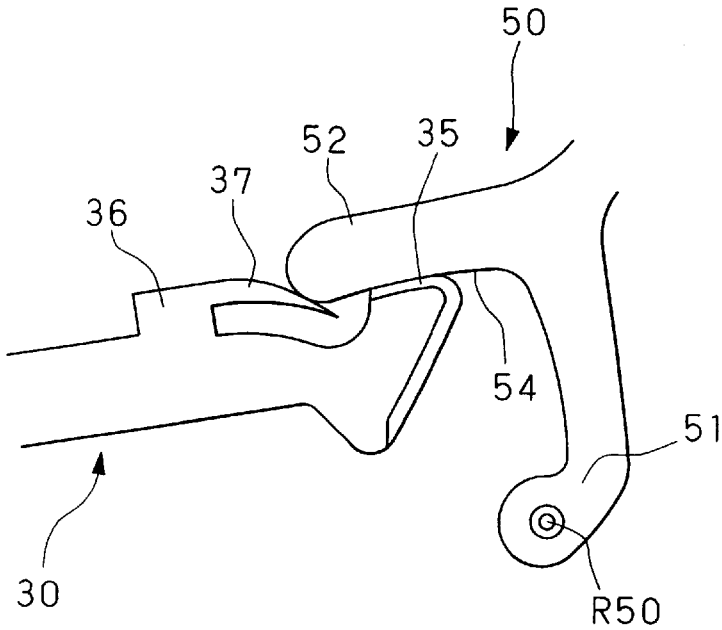
FIG. 3 is an enlarged view showing a positional relationship between the first and second moving members in connection with back checking after strong key depression.

In the present embodiment, the press-up portion 36 of the first moving member 30 is equipped with the claw 37 whose width or thickness becomes thin in the backward direction. This provides the second moving member 50 with the positional regulation as follows:

Due to the back checking effected after the "strong" key depression, the second moving member 50 returns with great force. Thus, even when the center projection 52 is brought into contact with the press-up portion 36 as shown in FIG. 3, the center projection 52 slides for a while and then stops at a position corresponding to the base end portion of the center projection 52. At this time, the tip end portion of the center projection 52 comes in contact with the press-up portion 36 of the first moving member 30. As described above, the back portion of the press-up portion 36 is made thin to form the claw 37. So, the tip end portion of the center projection 52 reaches a stop position thereof while pressing the claw 37 to deform in an elastic manner. In other words, similarly to the back-check portion 35, the claw 37 provides a cushioning effect for the impact created when the center projection 52 of the second moving member 50 makes a contact with the first moving member 30.

As described above, the back checking after the strong key depression is securely performed by the "concave" lower surface 54 of the center projection 52 and the claw 37 of the press-up portion 36. In short, the present embodiment is characterized to have an arrangement that the press-up portion 36 for driving the second moving member 50 at the key-depression mode is located in proximity to the back-check portion 35 for performing the back checking. Such an arrangement contributes to downsizing of the keyboard assembly as a whole.

Next, a description will be given with respect to a further effect which is obtained by the "secure" back checking.

Normally, the key-depression operation for the music performance is made in such a way that the performer touches the key 20 with his/her finger to depress down the key 20 to its lower-limit position. Then, the performer releases the key-depression operation so that the key 20 returns to the original position. At this time, the first moving member 30 and the second moving member 50 return to original positions thereof as well. So, the press-up portion 36 comes in contact with the center projection 52. Thus, the key 20 is placed in a wait state to wait for a next key-depression operation. In some performance, the performer hits a certain key repeatedly and very rapidly. In this case, the performer makes the next key-depression operation on the key 20 which slightly ascends up from the lower-limit position after the previous key-depression operation. In such "successive" key-depression operation of second time or so, both of the first moving member 30 and the second moving member 50 have not been yet returned to the original positions thereof. However, the second moving member 50 is retained in position corresponding to the back checking due to the aforementioned operation of the first moving member 30. Therefore, the back-check portion 35 of the first moving member 30 presses up the center projection 52 of the second moving member 50, so that the second moving member 50 is capable of rotating. As described above, even in the case of the rapid and repeated hitting of the key, it is possible to securely perform the key depression accompanied with rotation of the second moving member 50. For this reason, it is possible to offer the key-touch feeling continuously. If the acoustic musical instrument employs the present embodiment, it is possible to actualize the continuously repeated hitting of the sound body (e.g., string) by means of the second moving member.

To make a return of the second moving member speedily and to improve the repeated-hitting performance, it is possible to provide the rotation shaft 17 of the second moving member 50 with a return coil spring, for example.

Figure 6:
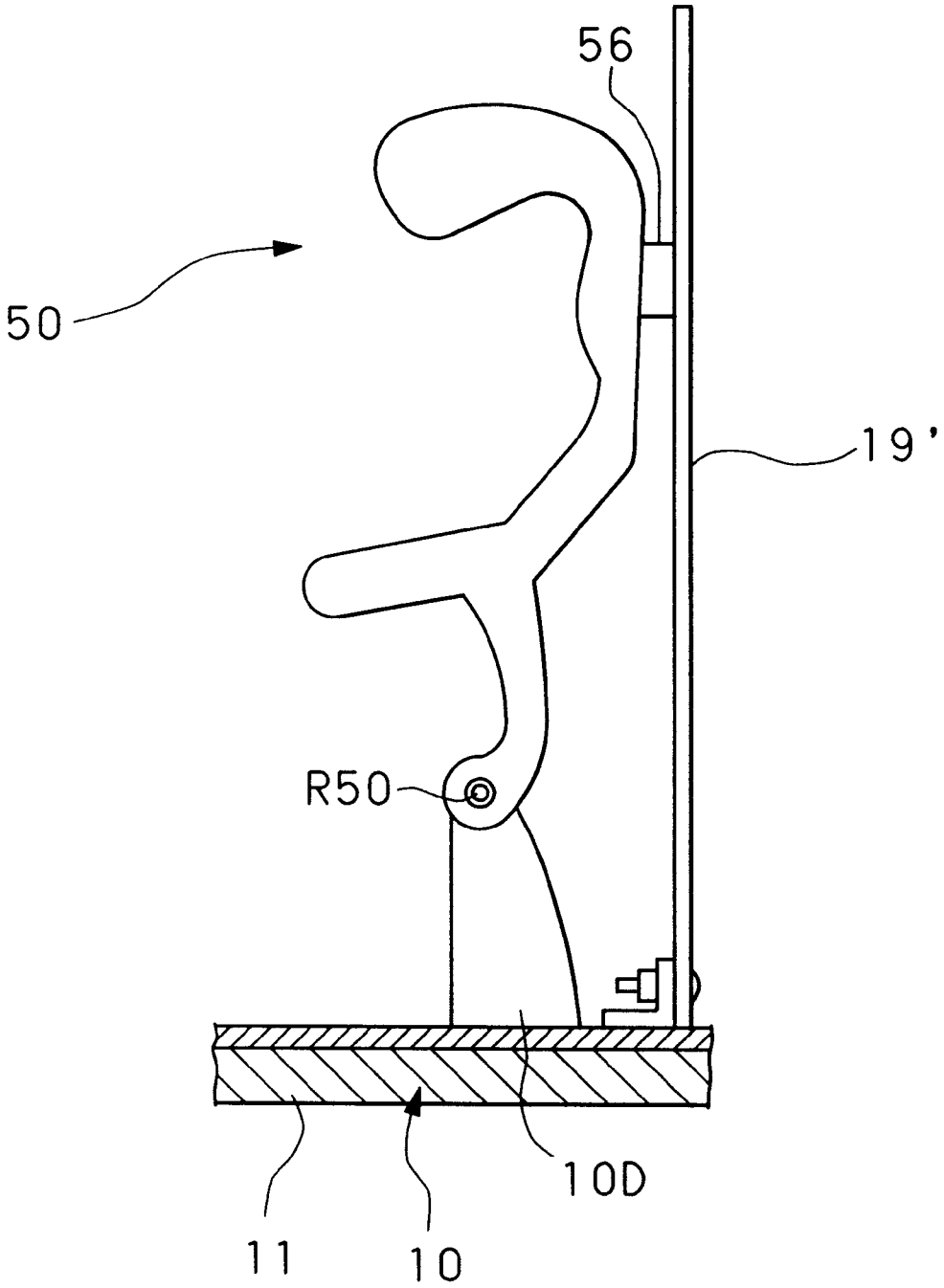
FIG. 6 is a sectional view showing a selected part in construction of a celesta which employs the second moving member in accordance with the embodiment 1.

Incidentally, the present embodiment is described mainly with respect to the keyboard assembly of the electronic piano. Of course, the construction of the keyboard assembly of the present embodiment is applicable to other musical instruments such as the piano and celesta of the acoustic musical instruments. In those acoustic musical instruments, the sound bodies correspond to strings or metal elements. Those sound bodies are located at the position of the contact element 19*a* shown in FIG. 1. FIG. 6 shows an example of the celesta in which a metal element 19' such as a steel bar is used as the sound body. To strike the sound body, a felt strike projection 56 is securely adhered to a back surface of the second moving member 50. Incidentally, the acoustic musical instruments do not require the aforementioned actuator 33, the switch board 42 and the conductive members 43, which are omitted.

[C] Embodiment 2

Next, a description will be given with respect to a construction of a keyboard assembly in accordance with embodiment 2 of the invention.

Figure 7:
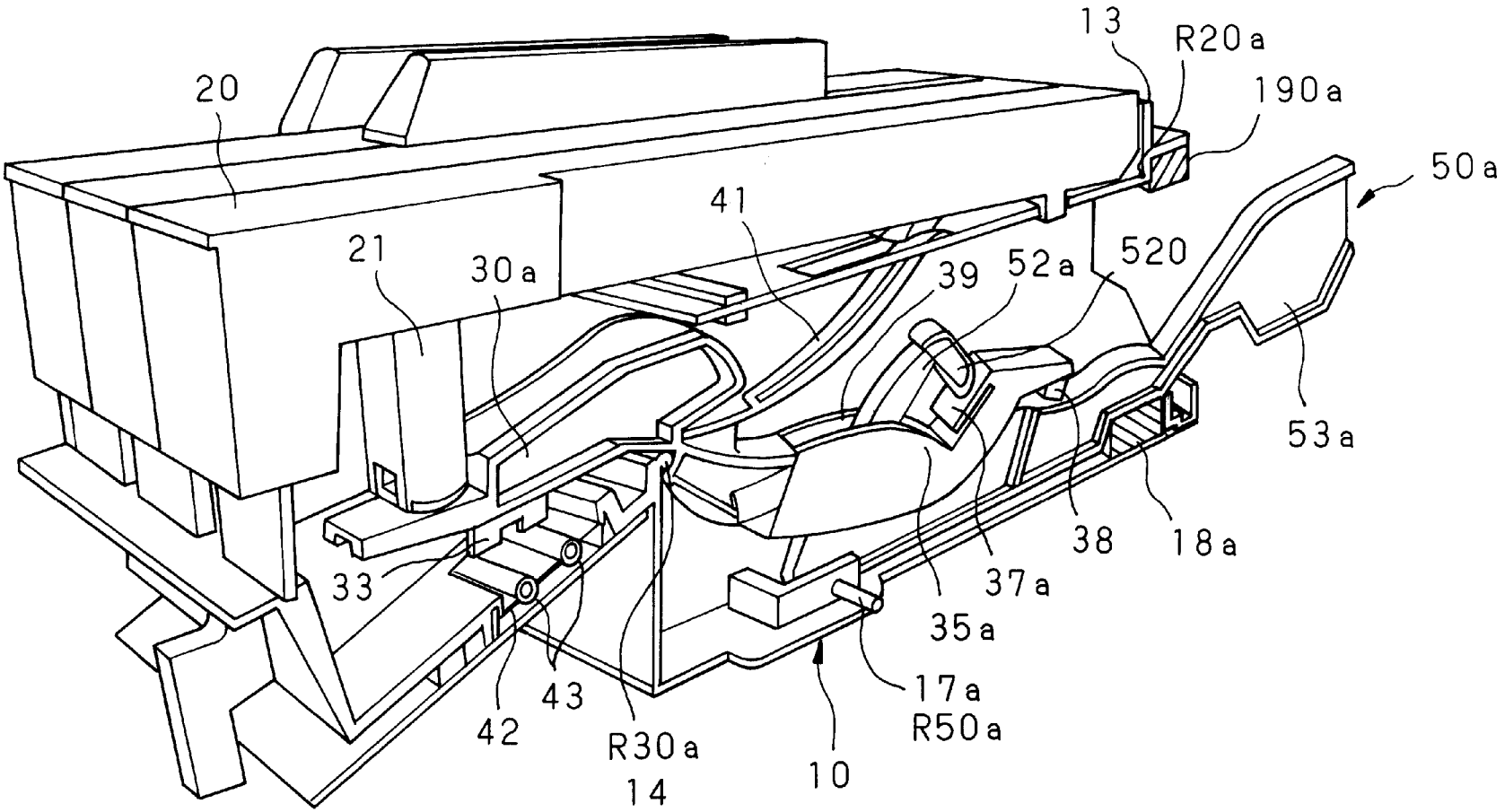
FIG. 7 is a perspective view partially in section that shows a construction of a selected part of a keyboard assembly for an electronic piano in accordance with embodiment 2 of the invention.

FIG. 7 shows an example of a keyboard assembly of the embodiment 2 for an electronic piano. In FIG. 7, parts equivalent to those shown in FIG. 1 are designated by the same numerals, hence, the description thereof will be omitted. In addition, parts of FIG. 7 whose functions are similar to the foregoing parts of FIG. 1 are designated by the same numerals each added with a suffix "a".

A main difference between the constructions of the keyboard assemblies shown in FIG. 1 and FIG. 7 is indicated by a second moving member 50*a* (whose function is similar to the foregoing second moving member 50), which is stored beneath the key 20. Thus, the keyboard assembly of FIG. 7 is designed with a compact size as compared with the foregoing keyboard assembly of FIG. 1.

Like the aforementioned keyboard assembly of FIG. 1, the keyboard assembly of FIG. 7 is constructed such that the back end portion of the key 20 is supported by the support member 13, and the key 20 is capable of rotating up and down about a rotation center R20*a*. In addition, a first moving member 30*a* is arranged beneath the key 20. The first moving member 30*a* are extended horizontally as a whole in front-back directions thereof. The first moving member 30*a* rotates about a rotation center R30*a*, at which the support element 14 of the keyboard frame 10 engages with a concave. An upper surface of a front end portion of the first moving member 30*a* comes in contact with the hang-down element 21 of the key 20. A back portion of the first moving member 30*a* extends to reach the back portion of the keyboard frame 10. The first moving member 30 is retained at a rest position thereof such that a felt contact element 38, attached to a lower surface of a back end portion of the first moving member 30, is brought into contact with an upper surface of a second moving member 50*a*. A dead space 39 is formed at a selected position of the back portion of the first moving member 30*a*, wherein it penetrates through the back portion of the first moving member 30*a* in a vertical direction. At the back side of the dead space 39, the first moving member 30*a* is equipped with a contact portion 35*a* and a claw 37*a* to press up the second moving member 50*a*.

The second moving member 50*a* is capable of rotating up and down about a shaft 17*a*, which is located beneath the dead space 39 of the first moving member 30*a*. The second moving member 50*a* is equipped with a small arm 52*a* and a big arm 53a. Herein, the small arm 52*a* elongates in a diagonal backward direction from a shaft support of the shaft 17*a*, while the big arm 53*a* elongates horizontally in a backward direction from the shaft support. Those arms as a whole are shaped like a letter "L". A stopping portion 520 is attached to a tip end portion of the small arm 52*a* and is enlarged in both of backward and width directions of the key to be brought into contact with the contact portion 35*a* and claw 37*a* of the first moving member 30*a*. At a back side of the support member 13, there is provided a contact element 190*a* which comes in contact with the second moving member 50*a* being rotated.

Figure 8:
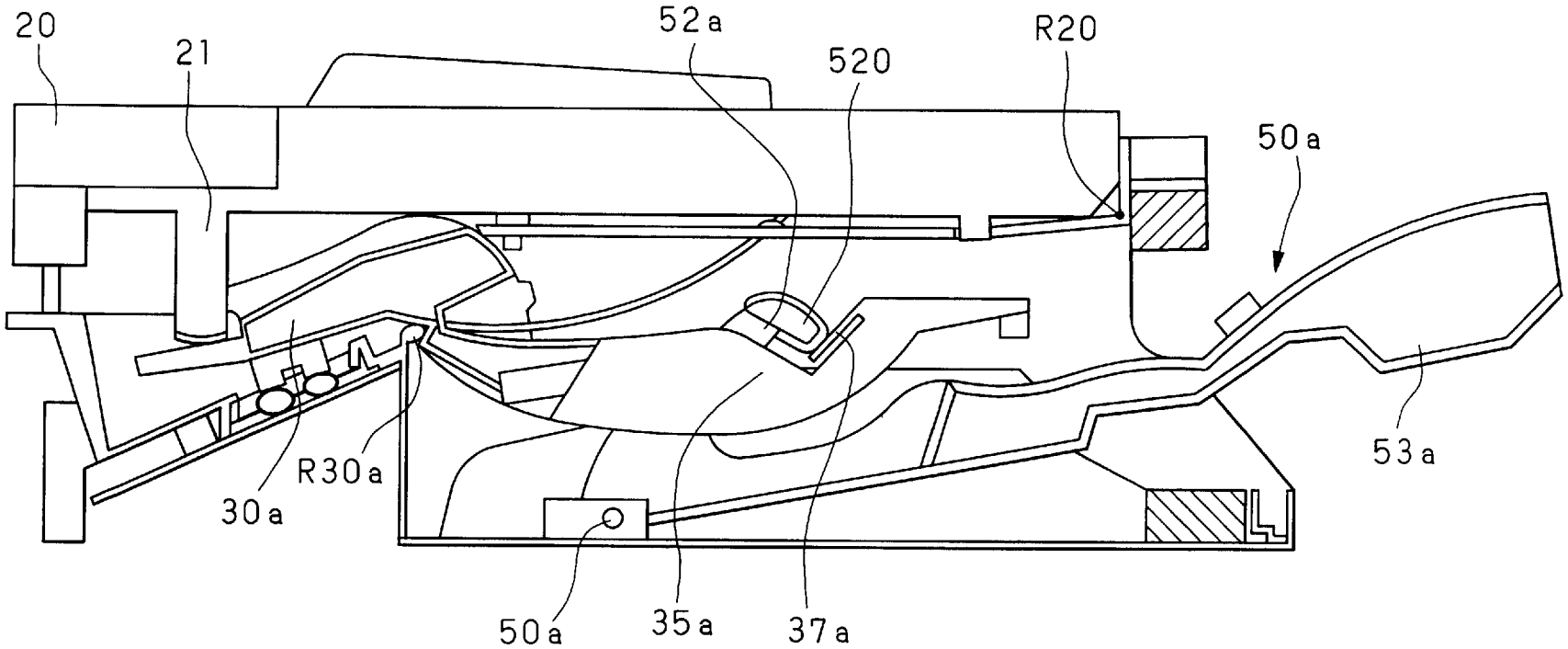
FIG. 8 is a sectional view showing a depressed state of a key and its associated members in the keyboard assembly of FIG. 7.
Figure 9:
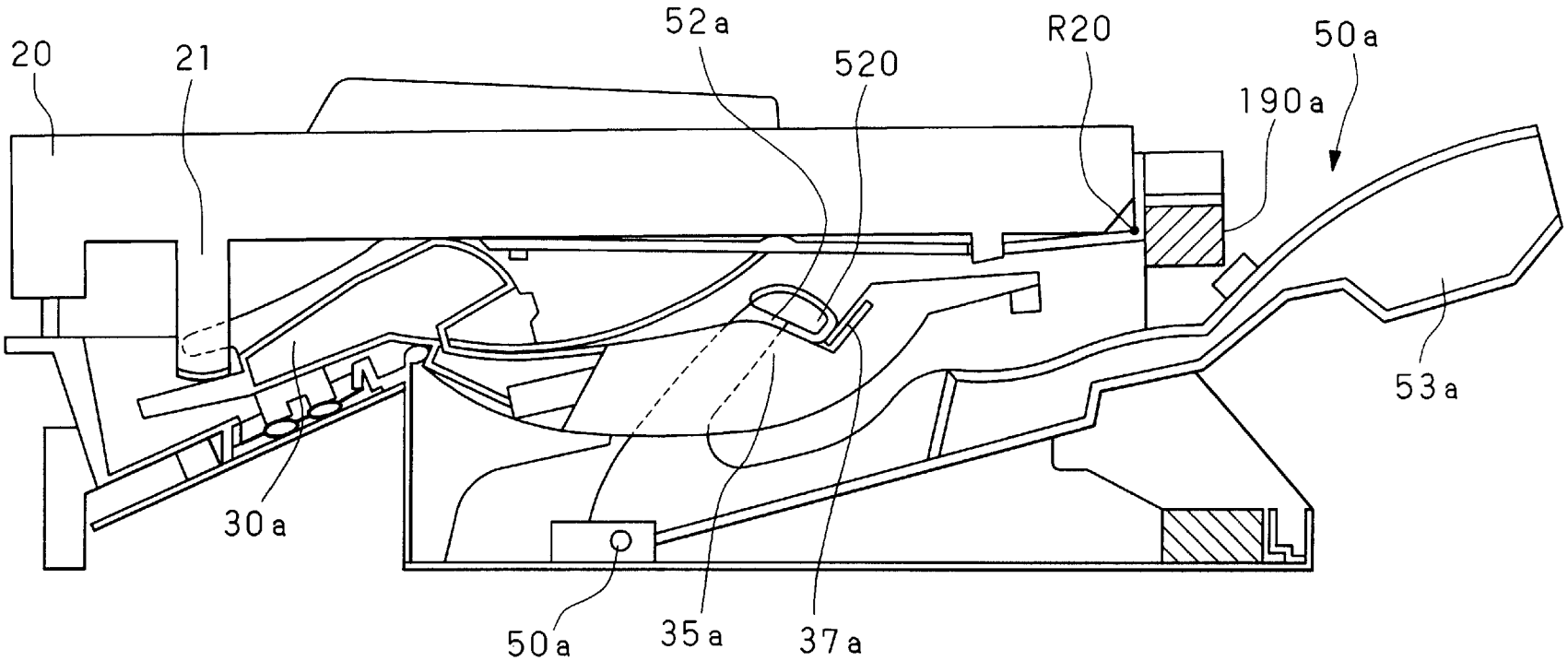
FIG. 9 is a sectional view showing a further depressed state of the key in which a back portion of a second moving member rotates up.

The keyboard assembly of FIG. 7 operates as follows:

When the human operator (or performer) makes key depression under a rest state of the keyboard assembly which is shown in FIG. 7, the key 20 rotates about the rotation center R20*a* as shown in FIG. 8, so that the hang-down element 21 presses down the front end portion of the first moving member 30*a*. Thus, the back portion of the first moving member 30*a* rotates upwardly about the rotation center R30*a*, so that the claw 37*a* presses up the stopping portion 520 of the second moving member 50*a*. Thus, the second moving member 50*a* rotates about the rotation center R50*a* in an upper forward direction. As rotation of the first moving member 30*a* progresses as shown in FIG. 9, the contact portion 35*a* further presses up the stopping portion 520 of the second moving member 50*a*. Thereafter, due to the inertia in motion of the second moving member 50*a*, a part of the second moving member 50*a* leaves from the contact portion 35*a* so that the back portion of the second moving member 50*a* comes in contact with the contact element 190*a*. At a state that the contact is (almost) established between the second moving member 50*a* and the contact element 190*a*, the actuator 33 of the key 20 comes in contact with a pair of the conductive members 43 so that the key-depression switch is turned on. This activates the sound mechanism to produce a musical tone.

Figure 10:
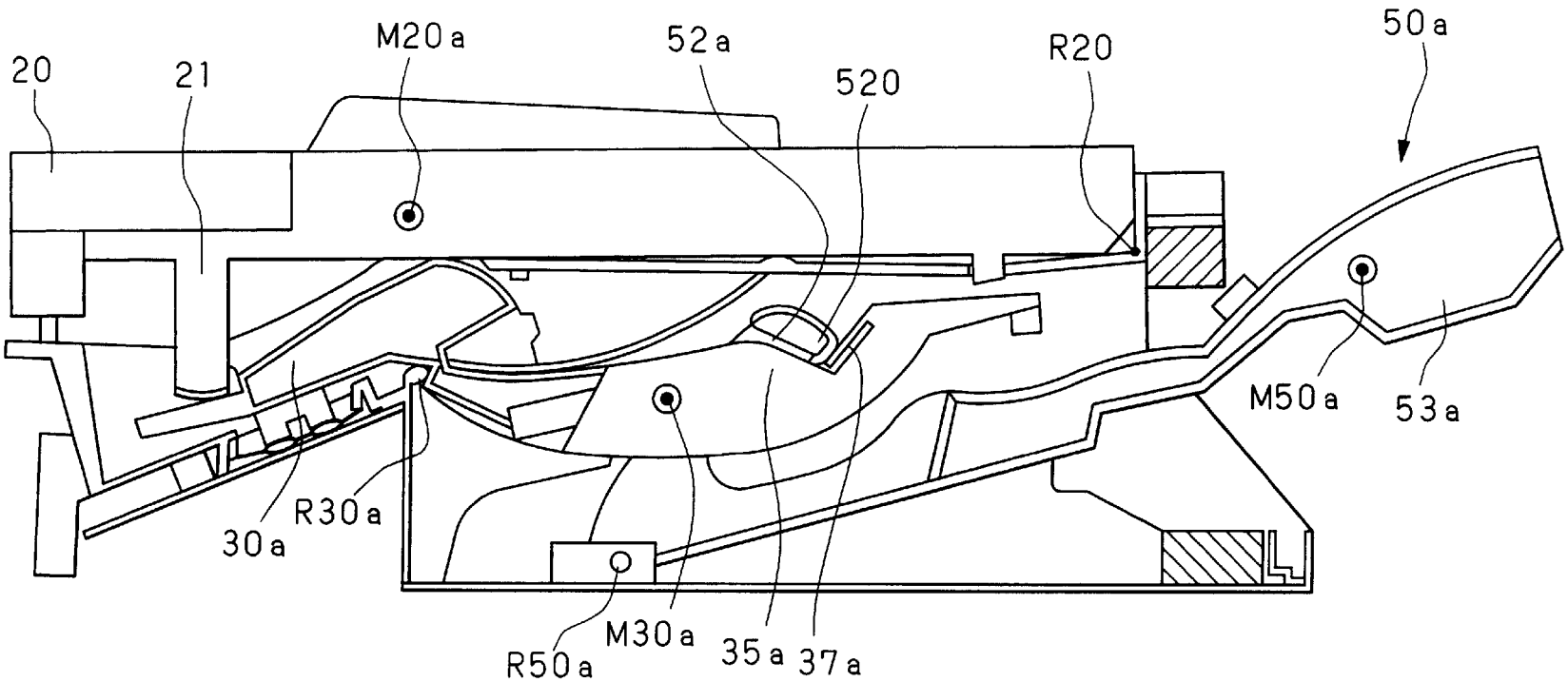
FIG. 10 is a sectional view showing a back-ckeck state where the second moving member is retained at a certain position.

The second moving member 50*a* whose back portion is brought into contact with the contact element 19*a* slightly moves back in a lower backward direction due to rebound at the contact. Therefore, the stopping portion 520 of the second moving member 50*a* comes in contact with the contact portion 35*a* of the first moving member 30*a*. Thus, the second moving member 50*a* is retained at a position which is slightly apart from the contact element 190*a*. This establishes a back-check state shown in FIG. 10. Such a back-check state of FIG. 10 is established due to "strong" key depression by which the stopping portion 520 slightly slides on the contact portion 35*a* so that sliding motion of the stopping portion 520 is stopped by the claw 37*a*. In the case of "weak" key depression, however, the stopping portion 520 is held by the contact portion 35*a* at a position prior to the claw 37*a*.

In the aforementioned back-check state of FIG. 10, a center of mass "M50*a*" of the second moving member 50*a* is located backwardly from the rotation center R50*a*. In addition, a center of mass "M20*a*" of the key 20 is located forward from the rotation center R20*a*. Further, a center of mass "M30*a*" of the first moving member 30*a* is located backwardly from the rotation center R30*a*. For this reason, when the human operator releases the key depression, all of the key 20, first moving member 30*a* and second moving member 50*a* are returned to rest positions respectively in such a way that the centers of mass thereof descend down due to the gravity. Incidentally, in order to make a return motion of the key 20 speedily, it is possible to provide a return coil spring around the rotation shaft of the second moving member 50*a*.

Like the foregoing keyboard assembly of the embodiment 1, the keyboard assembly of the present embodiment 2 is designed such that the second moving member 50*a* being interlocked with the key 20 at the key-depression mode has a larger mass and a longer moving distance of the center of mass than the key 20 and the first moving member 30*a* respectively. Therefore, it is possible to produce relatively large inertia force (or key-depression resistance force). Thus, it is possible to obtain relatively large inertia resistance by using relatively small mass.

[D] Modifications

Figure 13:
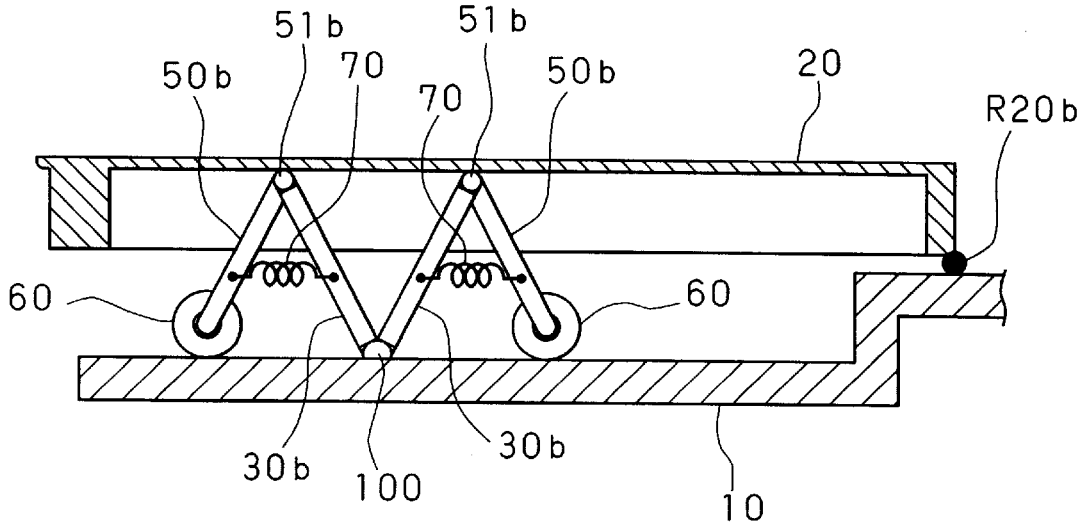
FIG. 13 is a longitudinal sectional view showing a construction of a selected part of a keyboard assembly which is designed in accordance with embodiment 3 of the invention.

FIG. 13 shows a construction of a selected part of a keyboard assembly which is designed in accordance with embodiment 3 of the invention. The foregoing keyboard assemblies shown in FIG. 1 and FIG. 7 are designed to employ somewhat "rotary motion system" in which a large-mass part (e.g., deadweight) of the moving member rotates with the moving member being rotated. In contrast, the keyboard assembly of FIG. 13 is designed to employ "rectilinear motion system" in which the large-mass part (e.g., deadweight) is subjected to rectilinear motion. For convenience' sake, FIG. 13 shows selected parts regarding the rectilinear motion such as the key, keyboard frame and deadweights of moving members. Other parts are similar to those used in the foregoing embodiments, hence, the description thereof will be omitted.

In FIG. 13, moving members are supported by the keyboard frame 10 and are arranged under the key 20. The key 20 has a hollow space whose opening directs downwardly. A back end portion of the key 20 is supported by the keyboard frame 10 such that it rotates about a rotation center R20*b*. As the moving members, there are provided a pair of first moving members 30*b* each constructed like a lever, a pair of second moving members 50*b* each constructed like a lever, and a pair of third moving members 60 each constructed like a roller as well as a pair of extension coil springs 70. Herein, the first moving members 30*b* are supported by a support portion 100 fixed to the keyboard frame 10 such that first ends thereof are capable of rotating. The second moving members 50*b* are interconnected with second ends of the first moving members 30*b* respectively via shaft portions 51*b*. Further, tip ends of the second moving members 50*b* are respectively equipped with the third moving members 60, which are capable of rotating by themselves. Furthermore, the extension coil springs 70 are provided to pull the first and second moving members mutually such that the first and second moving members are held to be located in proximity to each other. Thus, the moving members as a whole are shaped like a reversed letter of "W". Among those moving members, the third moving members 60 have the largest masses. In a non-key-depression state, the third moving members 60 are placed in contact with an upper surface of the keyboard frame 10. In addition, the shaft portions 51*b* are brought into contact with a top surface of the key 20, wherein due to effects of the extension coil springs 70, the shaft portions 51 press up the key 20. Herein, the key 20 comes in contact with a stopper (not shown) so that it is retained at an upper-limit position thereof.

Each of the first moving members 30*b* has a center of mass, which is located at a center portion of the lever in its longitudinal direction. Similarly, each of the second moving members 50*b* has a center of mass, which is located at a center portion of the lever in its longitudinal direction. Each of the third moving members has a center of mass, which is located at a center portion of the roller.

In the keyboard assembly of FIG. 13, certain angles are formed between the first moving members 30*b* and the second moving members 50*b* respectively. So, the first moving members 30*b* and the second moving members 50*b* rotate respectively to broaden (or increase) the angles therebetween. Thus, the third moving members 60 are subjected to rectilinear motions along the upper surface of the keyboard frame 10. Due to such rectilinear motions, each of the second moving members 50*b* is subjected to rotation of a large angular velocity which is roughly two times larger than an angular velocity of each of the first moving members 30*b* being subjected to rotation. In addition, the third moving members 60 are arranged to conform with the tip ends of the second moving members 50*b*. Hence, the third moving members 60 have the longest moving distances among the moving member. For this reason, the keyboard assembly of the embodiment 3 is capable of efficiently producing the large inertia force (or large key-depression resistance force). Thus, it is possible to obtain relatively large inertia resistance by using relatively small mass.

Incidentally, like the foregoing keyboard assembly of FIG. 1, the keyboard assemblies of FIG. 7 and FIG. 13 are applicable to the other musical instruments, other than the electronic pianos, such as the acoustic piano and celesta of the acoustic musical instruments.

In the embodiments, the intermediate moving member is constructed using a single moving member. However, it is possible to modify the embodiments such that the intermediate moving member is constructed using two moving members or more which are interlocked with each other.

[E] Manufacturing Method of Keyboard Assembly

Next, a description will be given with respect to the manufacturing method of the keyboard assembly. This method is characterized to provide an easy way for calculations (or setting) of the aforementioned magnification ratio "k" for operations establishes between the key and the moving member(s) being interlocked with the key as well as an appropriate amount of the mass "m". Namely, this method determines the mass m of the mass body as well as the magnification ratio k of the operation speed of the mechanical magnification system in accordance with the foregoing equation (4) as follows:

$$k^2m=(FT^2)/(2D)$$

Now, a description will be given with respect to the calculations which are performed with regard to the keyboard assembly of FIG. 1, for example.

Suppose that the key-depression force F applied to the key 20 is 200 g, the maximal moving distance D at the key-depression position is 1 cm, and the time T required for the key depression to achieve the moving distance D is 0.15 second. Herein, the force is subjected to unit conversion using "N (Newton)" to produce a value, which is input to the aforementioned equation (4), as follows:

$$k^2m=\{(0.2\times9.8)\times0.15^2\}/(2\times0.01)=2.21 \quad (4')$$

If "8" is set to the magnification ratio of the mechanical magnification system by the first moving member 30 and the second moving member 50, it is possible to calculate the mass m based on the calculated value of the equation (4'), as follows:

$$m=2.21/8^2=0.034\ (kg)$$

Therefore, it can be said that an appropriate mass of the deadweight applied to the second moving member 50 is "34 g".

If "10" is set to the magnification ratio k, it is possible to calculate the mass m based on the equation (4'), as follows:

$$m=2.21/10^2=0.022\ (kg)$$

Therefore, it can be said that an appropriate mass of the deadweight applied to the second moving member 50 is "22 g".

The aforementioned calculations neglect masses of other elements other than the deadweight. The calculations should be actually concerned with the key 20 and the first moving member 30 as well as the second moving member 50 excluding the deadweight. So, it is considered that those elements actually influence results in final determination of the mass of the deadweight.

Anyway, the present manufacturing method performs determination of specifications of the keyboard assembly in accordance with the foregoing equation (4), wherein the magnification ratio k of the mechanical magnification system is made large. Namely, by making the moving distance of the mass body large, it is possible to reduce the mass m of the mass body to be inversely proportional to $k^2$. As a result, it is possible to considerably reduce the mass m. Therefore, some magnification ratio does not always require a weight distribution in which the mass of the mass body is made greater than the masses of the other elements such as the key and moving member(s). Without such a weight distribution, it is possible to efficiently produce the inertia force (or key-depression resistance force).

Moreover, the keyboard assembly of this invention has technical features as follows:

In the normal key depression which is made intensely for some playing technique such as pianissimo, fidelity is secured for transmission of force which is transmitted from the key to the hammer so that reactive force is securely imparted back to the finger that depresses the key. When the key is depressed extremely weak, the keyboard assembly brings some delay element to the transmission of the force. Thus, the key touch of the keyboard assembly of this invention can be made similar to the key touch of the grand piano. That is, the grand piano is constructed such that no sound is produced even when the performer depresses the key very slowly so that the key slowly moves to its key-depression end position. In addition, the key-touch feeling for the key to produce the sound differs from the key-touch feeling for the key not to produce the sound. In other words, there is provided a discontinuity between those key-touch feelings. This invention is capable of simulating such a unique feature of the grand piano. Further, the keyboard assembly of this invention is equipped with the back-check mechanism, by which it is possible to repeatedly produce the same sound again with ease. Furthermore, members and parts of the keyboard assembly are constructed in a multi-function manner, so that the complicated functions and operations of the keyboard assembly can be obtained by the simple construction. For example, one member (e.g., elastic body) achieves multiple functions, e.g., touch-related function and back-check function. This may be called an abutment effect.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A keyboard assembly for a keyboard instrument, comprising:

a key which is supported by a support member to have a capability of free reciprocating motion;

an intermediate moving member which is interlocked with the key at a key-depression mode to perform a reciprocating motion within a prescribed range of distance;

a large-mass moving member which is interlocked with the intermediate moving member to perform a reciprocating motion within a prescribed range of distance; and a tone-generation control whose tone generation is controlled by the key which is depressed, wherein the large-mass moving member has a greater weight and a longer moving distance as compared with those of the key and those of the intermediate moving member.

2. A keyboard assembly according to claim 1 wherein each of the key, the intermediate moving member and the large-mass moving member performs axial rotation about an axis, and wherein a rotation radius portion of the large-mass moving member of a moment of inertia about the axis of the rotation radius portion has a longer moving distance as compared with that of rotation radius portions of the key and intermediate moving member.

3. A keyboard assembly according to claim 1 wherein the large-mass moving member is subjected to rectilinear motion guided by a guide portion, and wherein a center of mass of the large-mass moving member has a longer moving distance as compared with that of the center mass of the key and the center mass of the intermediate moving member.

4. A manufacturing method for a keyboard assembly which is constructed by a key being supported by a support member to have a capability of free reciprocating motion, a mechanical magnification system of an operation speed being interlocked with the key at a key-depression mode, a mass body being interlocked with an output of the mechanical magnification system to perform a reciprocating motion, and tone-generation control means for controlling tone generation by key depression of the key, said manufacturing method comprising the steps of:

setting prescribed values to key-depression force F, a maximal moving distance D at a key-depression position of the key and a time T required to achieve a key-depression operation corresponding to the maximal moving distance D; and determining a mass m of the mass body and a magnification ratio k of the operation speed of the mechanical magnification system in accordance with a relational expression of $$k^2m \approx (FT^2)/(2D).$$

5. A keyboard assembly for a keyboard instrument, comprising:

a key which is supported by a support member to have a capability of free reciprocating motion;

an intermediate moving member which is interlocked with the key at a key-depression mode to perform a reciprocating motion within a prescribed range of distance;

a large-mass moving member which is interlocked with the intermediate moving member to perform a reciprocating motion within a prescribed range of distance; and tone-generation control means for controlling tone generation by key depression of the key, wherein at the key-depression mode, a center of mass of the large-mass moving member rotates upwardly about a rotation center thereof from a rest position which corresponds to an approximately horizontal place to a rotation position which corresponds to an approximately vertical place, so that at the rotation position, the center of mass of the large-mass moving member is located closer to the rest position rather than a vertical line passing through the rotation center of the large-mass moving member.

6. A keyboard assembly for a keyboard instrument, comprising:

a key which is supported by a keyboard frame to have a capability of rotating up and down about a rotation center;

a first moving member which is arranged beneath the key and which is subjected to rotary motion about a first rotation center while being interlocked with depression of the key, so that a back portion of the first moving member rotates up;

a second moving member which is greater in mass and has a longer moving distance as compared with those of the key and those of the first moving member, wherein the second moving member being normally located at a rest position is subjected to rotary motion about a second rotation center in response to a press-up motion of the back portion of the first moving member, so that the second moving member rotates backwardly and is stopped at a contact member, then, the second moving member is subjected to back checking by which the second moving member is slightly moved forward and is temporarily fixed in position as long as the depression of the key is maintained; and a tone-generating element for producing a musical tone in response to the depression of the key, wherein a center of mass of the key is located forwardly from the rotation center thereof, a center of mass of the first moving member is located backwardly form the first rotation center thereof, and a center of mass of the second moving member is normally located forwardly from the second rotation center thereof, while the center of mass of the second moving member at the contact position is located slightly forward for the second rotation center thereof.

7. A keyboard assembly according to claim 6 wherein the key has a hang-down element which projects downwardly from an under surface of the key and which presses down a front end portion of the first moving member, which is arranged forwardly from the first rotation center, to depress the key-depression switch in response to the depression of the key.

8. A keyboard assembly according to claim 6 wherein a deadweight is provided in connection with a tip end portion of the second moving member to determine location of the center of mass of the second moving member.

9. A keyboard assembly according to claim 8 wherein a mass m of the deadweight is determined in accordance with a relational expression of $$k^2m \approx (FT^2)/(2D)$$

where k denotes a magnification ratio, F denotes key-depression force, D denotes a maximal moving distance of the key at its key-depression position, and T denotes a time required for the key to achieve the maximal moving distance D.

10. A keyboard assembly according to claim 6 wherein the second moving member is formed roughly in a reverse-W shape to have a center projection, which projects downwardly and which is brought into contact with a back end portion of the first moving member, which is arranged backwardly from the center of mass of the first moving member, and wherein in response to the depression of the key, the back end portion of the first moving member rotates upwardly to press up the center rotation of the second moving member, so that a tip end portion of the second moving member, which is located opposite to the second rotation center of the second moving member and is normally located at a rest position concerned with a back end portion of the key, rotates backwardly so that the second moving member moves toward the contact position.

11. A keyboard assembly according to claim 10 wherein the back end portion of the first moving member is constructed by a back-check portion which is a terminal end of the back portion of the first moving member, a press-up portion which is located slightly forward from the back-check portion and which projects upwardly, and a claw which is formed as a tip end of the press-up portion and is elongated toward the back-check portion, and wherein in response to the depression of the key, the press-up portion presses up the center projection of the second moving member, then, at the contact position of the second moving member, the back-check portion comes in contact with a concave which is formed as a lower surface of the center projection, thereafter, when the second moving member moves slightly forward from the contact position, the concave of the center projection slides on an upper surface of the back-check portion so that a tip end of the center projection is temporarily stopped by the claw.

12. A keyboard assembly according to claim 11 wherein the concave of the center projection of the second moving member is determined in shape such that a distance measured from the second rotation center becomes slightly small in a direction from the tip end of the center projection to a base end of the center projection.

13. A keyboard assembly comprising:

a support member;

a first rotation member which is fixed to the support member to have a capability of free rotation and which is swung by a driven portion thereof being driven; and a second rotation member which is fixed to the support member to have a capability of free rotation and which is swung in response to force that a driving portion of the first rotation member transmits to a driven portion thereof, wherein at a non-rotation mode, the driving portion of the first rotation member is placed in contact with the driven portion of the second rotation member with rigidity, while as rotations of the first rotation member and the second rotation member progress, the driving portion of the first rotation member and the driven portion of the second rotation member contact with each other in an elastic manner.

14. A keyboard assembly according to claim 13 further comprising:

a positional regulating means that is located in proximity to the driving portion of the first rotation member and the driven portion of the second rotation member for stopping the rotation of the second rotation member at its rotation end position wherein the rotation of the second rotation member is made such that the driving portion of the first moving member drives the driven portion of the second rotation member; and a back-check member which stops a return motion of the second rotation member at a relatively proximal position of the first rotation member and the second rotation member, rotations of which are stopped by the positional regulating means.

15. A keyboard assembly according to claim 14 wherein the driven portion of the second rotation member has an elastic means for assisting a back-check function of the back-check member in proximity to a rotation end position.

16. A keyboard assembly comprising:

a support member;

a key which is fixed to the support member to have a capability of free swing;

a first rotation member which is fixed to the support member to have a capability of free rotation and which is swung by a driving portion of the key which is depressed down; and a second rotation member which is fixed to the support member to have a capability of free rotation and which is swung by force that a driving portion of the first rotation member transmits to a driven portion thereof when the key is depressed down, wherein at a non-rotation mode, the driving portion of the first rotation member is placed in contact with the driven portion of the second rotation member with rigidity, while as rotations of the first rotation member and the second rotation member progress, the driving portion of the first rotation member contacts with the driven portion of the second rotation member in an elastic manner.

17. A keyboard assembly according to claim 16 further comprising:

a positional regulating means that is located in proximity to the driving portion of the first rotation member and the driven portion of the second rotation member for stopping the rotation of the second rotation member at its rotation end position, wherein the rotation of the second rotation member is made such that the driving portion of the first moving member drives the driven portion of the second rotation member; and a back-check member which stops a return motion of the second rotation member at a relatively proximal position of the first rotation member and the second rotation member, rotations of which are stopped by the positional regulating means.

18. A keyboard assembly according to claim 17 wherein the driven portion of the second rotation member has an elastic means for assisting a back-check function of the back-check member in proximity to a rotation end position.

19. A keyboard assembly for a keyboard instrument, comprising:

a key which is supported by a support member to have a capability of free reciprocating motion;

an intermediate moving member which is interlocked with the key at a key-depression mode to perform a reciprocating motion within a prescribed range of distance;

a large-mass moving member which is interlocked with the intermediate moving member to perform a reciprocating motion within a prescribed range of distance; and a tone-generation control whose tone generation is controlled by the key which is depressed, wherein the large-mass moving member has a greater weight and a longer moving distance as compared with those of the key and those of the intermediate moving member, the large-mass moving member being subjected to rectilinear motion guided by a guide portion, and wherein the large-mass moving member has a longer moving distance from a center of mass thereof as compared with the key and the intermediate moving member.

20. A keyboard assembly comprising:

a support member;

a first rotation member which is fixed to the support member to have a capability of free rotation and which is swung by a driven portion thereof being driven;

a second rotation member which is fixed to the support member to have a capability of free rotation and which is swung in response to force that a driving portion of the first rotation member transmits to a driven portion thereof, wherein at a non-rotation mode, the driving portion of the first rotation member is placed in contact with the driven portion of the second rotation member with rigidity;

a positional regulating means that is located in proximity to the driving portion of the first rotation member and the driven portion of the second rotation member for stopping the rotation of the second rotation member at its rotation end position wherein the rotation of the second rotation member is made such that the driving portion of the first moving member drives the driven portion of the second rotation member; and a back-check member which stops a return motion of the second rotation member at a relatively proximal position of the first rotation member and the second rotation member, rotations of which are stopped by the positional regulating means.

21. A keyboard assembly comprising:

a support member;

a key which is fixed to the support member to have a capability of free swing;

a first rotation member which is fixed to the support member to have a capability of free rotation and which is swung by a driven portion of the key which is depressed down;

a second rotation member which is fixed to the support member to have a capability of free rotation and which is swung by force that a driving portion of the first rotation member transmits to a driven portion thereof when the key is depressed down, wherein at a non-rotation mode, the driving portion of the first rotation member is placed in contact with the driven portion of the second rotation member with rigidity;

a positional regulating means that is located in proximity to the driving portion of the first rotation member and the driven portion of the second rotation member for stopping the rotation of the second rotation member at its rotation end position wherein the rotation of the second rotation member is made such that the driving portion of the first moving member drives the driven portion of the second rotation member; and a back-check member which stops a return motion of the second rotation member at a relatively proximal position of the first rotation member and the second rotation member, rotations of which are stopped by the positional regulating means.

22. A keyboard assembly according to claim 20 wherein the driven portion of the second rotation member has an elastic means for assisting a back-check function of the back-check member in proximity to a rotation end position.

23. A keyboard assembly according to claim 21 wherein the driven portion of the second rotation member has an elastic means for assisting a back-check function of the back-check member in proximity to a rotation end position.

* * * * *